US007824197B1

(12) United States Patent
Westman et al.

(10) Patent No.: US 7,824,197 B1
(45) Date of Patent: Nov. 2, 2010

(54) MODULAR CONNECTOR SYSTEM

(75) Inventors: John Eugene Westman, Harrisburg, PA (US); Brian Keith McMaster, Jr., Dillsburg, PA (US); Michael W. Fogg, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/576,691

(22) Filed: Oct. 9, 2009

(51) Int. Cl.
*H01R 4/66* (2006.01)

(52) U.S. Cl. ..... 439/108; 439/607.07

(58) Field of Classification Search ..... 439/108, 439/607.05, 607.07
See application file for complete search history.

(56) References Cited

U.S. PATENT DOCUMENTS 6,231,391 B1 * 5/2001 Ramey et al. ..... 439/607.07

7,175,446 B2 2/2007 Bright et al.

* cited by examiner

*Primary Examiner*—Tho D Ta

(57) ABSTRACT

A connector assembly includes a contact module, signal contacts, and a ground contact. The contact module includes a dielectric body with mating and mounting edges and corresponding opposite back edges. The signal contacts are held within the contact module. The signal contacts include mating and mounting ends that protrude from the mating and mounting edges of the contact module, respectively. The signal contacts are arranged in a differential pair to convey differential signals. The ground contact is coupled to the contact module and includes mating and mounting ends that protrude from the mating and mounting edges of the contact module, respectively. The ground contact runs alongside the back edges of the contact module from the mounting edge to the mating edge.

20 Claims, 9 Drawing Sheets

MODULAR CONNECTOR SYSTEM

BACKGROUND OF THE INVENTION

One or more embodiments of the invention described herein generally relate to electrical connectors and, more particularly, to a connector system for communicating relatively high speed differential signals.

Modular connectors are used in electronic systems, such as computer systems. The modular connectors may be used to connect various components within the systems, such as devices or networks, with the computers. Typically, the modular connectors represent either a plug assembly or a header assembly each of which is mated with another connector to provide an electrical connection between components of the system. The modular connectors typically include several signal contacts and ground contacts. The signal and ground contacts may be arranged in rows and/or columns. Some known connectors include signal contacts arranged in pairs that, along with a corresponding ground contact, form a contact set that transmits a differential signal. Electrical interference and cross talk may occur between the signal contacts of adjacent contact sets. For example, two adjacent signal contacts may electrically interfere and produce cross-talk with each other. The electrical interference and cross-talk among signal contacts may reduce the speed and operating efficiency of the connector.

The magnitude of cross-talk and interference may increase as the density of signal contacts in the connector is increased. The continuing trend toward smaller connectors operating at faster data rates leads to continuing increases in the density of the signal contacts. As a result, less room is provided for the ground contacts in the connectors and the magnitude of the cross-talk and interference may increase. Manufacturing such modular connectors may be difficult and time consuming due to the increased density and/or decreased size of the modular connectors and the reduced area available for providing ground contacts in the connectors. For example, the placement of ground contacts in relatively close proximity to signal contacts in a small connector may be difficult to accomplish.

Thus, a need exists for modular connectors that have a high contact density and reduced electrical noise.

BRIEF DESCRIPTION OF THE INVENTION

In one embodiment, a connector assembly is provided. The connector assembly includes a contact module, signal contacts, and a ground contact. The contact module includes a dielectric body with mating and mounting edges and corresponding opposite back edges. The signal contacts are held within the contact module. The signal contacts include mating and mounting ends that protrude from the mating and mounting edges of the contact module, respectively. The signal contacts are arranged in a differential pair to convey differential signals. The ground contact is coupled to the contact module and includes mating and mounting ends that protrude from the mating and mounting edges of the contact module, respectively. The ground contact runs alongside the back edges of the contact module from the mounting edge to the mating edge.

In another embodiment, another connector assembly is provided. The connector assembly includes a housing, contact modules, signal contacts, and ground contacts. The housing has a mating side that includes mating faces adapted to mate with mating connectors. The contact modules are held in the housing and include planar bodies with mating and mounting edges and corresponding opposite back edges. The signal contacts are held by the contact modules and include opposing contact beams that protrude from the mating edges of the contact modules. A first set of the contact beams is disposed in one of the mating faces of the housing and a second set of the contact beams is disposed in another one of the mating faces. The signal contacts are arranged in differential pairs in each of the upper and lower sets to separately convey differential signals. The ground contacts are coupled to the contact modules and include contact beams that protrude from the mating edges of the contact modules. The contact beams of the ground contacts are arranged on opposite sides of the differential pairs of the signal contacts in each of the upper and lower sets of signal contacts. The ground contacts have contact beams arranged on opposite sides of the signal contacts in the upper set that are joined to a common body running alongside the back edges of the contact modules from the mounting edges to the mating edges.

DETAILED DESCRIPTION OF THE INVENTION

Figure 1:
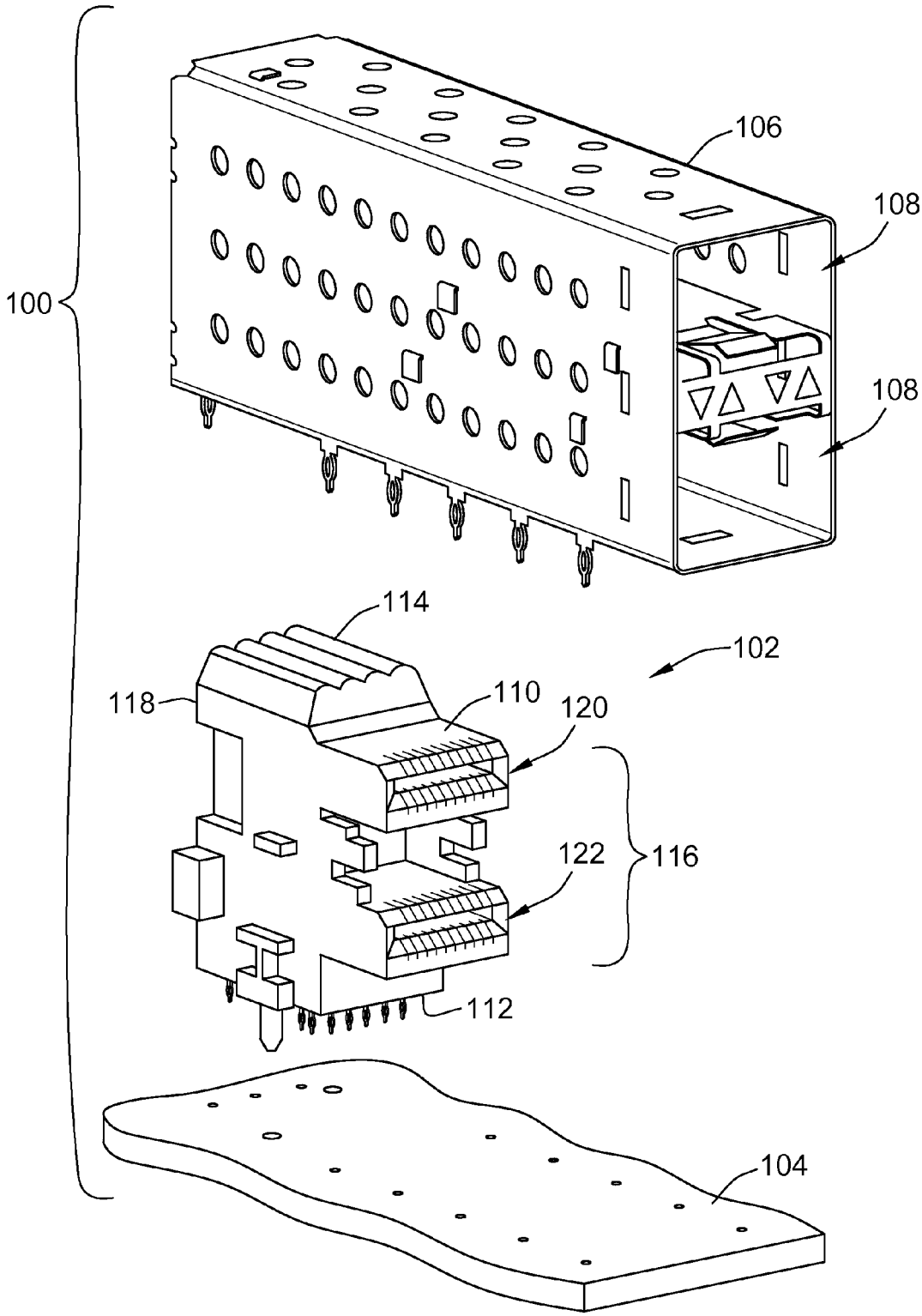
FIG. 1 is an exploded view of a modular connector system in accordance with one embodiment of the present disclosure.

FIG. 1 is an exploded view of a modular connector system 100 in accordance with one embodiment of the present disclosure. The system 100 includes a connector assembly 102 mounted to a circuit board 104. The connector assembly 102 may be disposed within a connector cage 106 that also is mounted to the circuit board 104. The connector cage 106 may be mounted to the circuit board 104 to electrically couple the connector cage 106 with an electric ground reference of the circuit board 104. The connector cage 106 may shield the connector assembly 102 from electromagnetic interference. The connector cage 106 is a conductive body that includes several ports 108. The ports 108 receive mating connectors (not shown) that mate with the connector assembly 102 to communicate data and/or power therebetween. By way of non-limiting example only, the ports 108 may have dimensions that are sized to receive a small form-factor pluggable connector or transceiver that mates with the connector assembly 102.

The connector assembly 102 includes a housing 110 that is mounted to the circuit board 104. The housing 110 may include, or be formed from, a dielectric material, such as one or more polymers. The housing 110 includes a mounting side 112 and an opposite top side 114 in the illustrated embodiment. The mounting side 112 may engage the circuit board 104 when the connector assembly 102 is mounted to the circuit board 104. The housing 110 also includes a mating side 116 and an opposite loading side 118. The mating side 116 includes two mating faces or interfaces 120, 122 disposed one above the other in a vertically stacked arrangement. Alternatively, the mating faces 120, 122 may be laterally mounted, or disposed side-by-side. As shown in FIG. 1, the mating faces 120, 122 forwardly project from the mating side 116. The mating faces 120, 122 are located within the ports 108 when the connector assembly 102 is disposed within the connector cage 106. The mating faces 120, 122 mate with the mating connectors (not shown) when the mating connectors are loaded into the ports 108.

Figure 2:
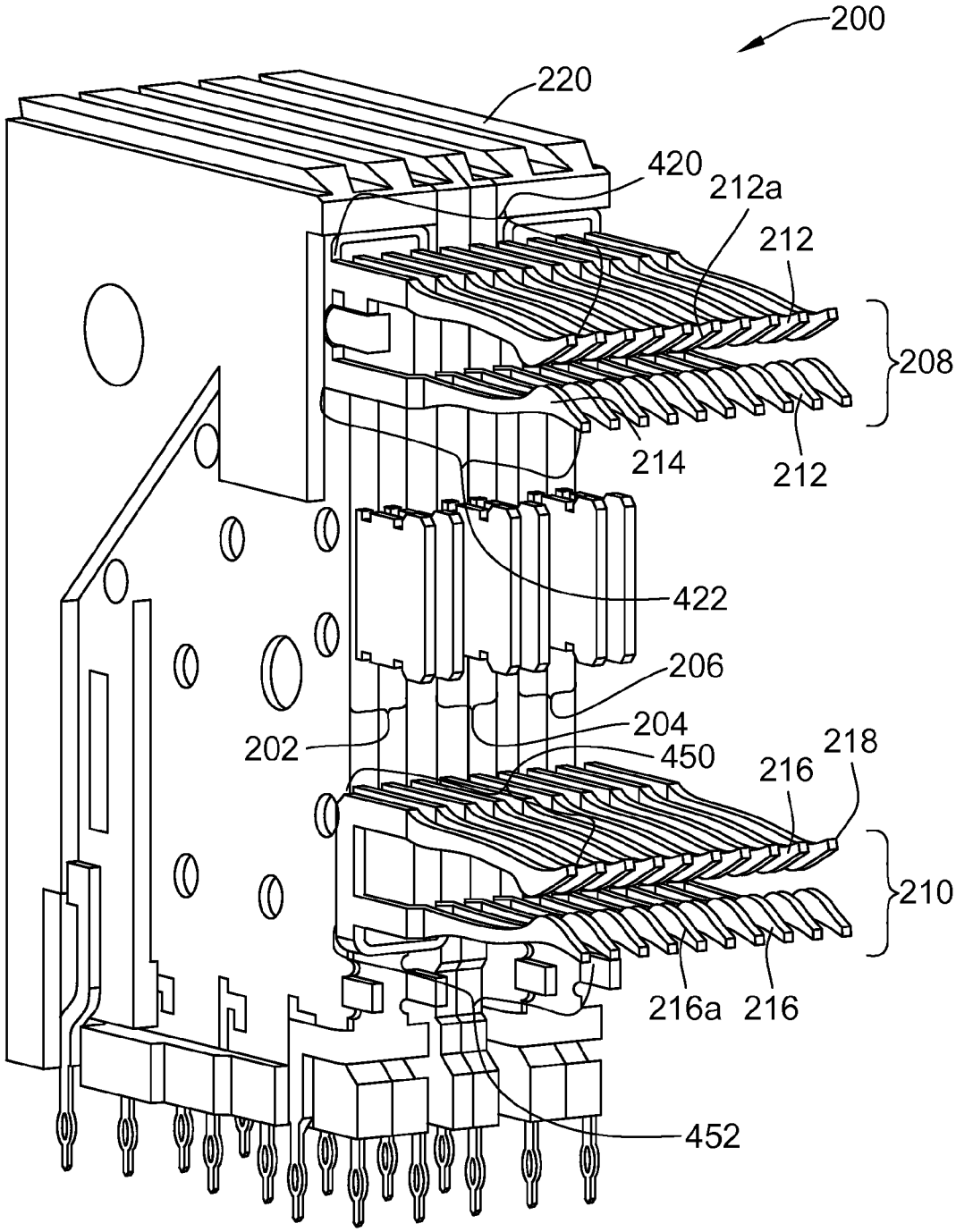
FIG. 2 is a perspective view of a contact module subassembly in accordance with one embodiment of the present disclosure.

FIG. 2 is a perspective view of a contact module subassembly 200 in accordance with one embodiment of the present disclosure. The contact module subassembly 200 is disposed within the connector assembly 102 (shown in FIG. 1). For example, the contact module subassembly 200 may be held within the housing 110 (shown in FIG. 1). The contact module subassembly 200 includes several contact modules 202, 204, 206 held side-by-side. For example, the contact modules 202-206 may abut one another. The number of contact modules 202-206 may differ from the three shown in FIG. 2.

In the illustrated embodiment, the subassembly 200 includes cap bodies 220 joined to the contact modules 202, 206. As shown in FIG. 2, the contact module 204 may not have a cap body 220. The cap bodies 220 may include, or be formed from, a dielectric material. For example, the cap bodies 220 may be molded from one or more polymers. Alternatively, the cap bodies 220 may include, or be formed from, a conductive material, such as a metal or metal alloy. As described below, the cap bodies 220 secure ground contacts 214 to the contact modules 202, 206.

The contact modules 202-206 include two groups of contacts, including an upper group 208 and a lower group 210. The group 208 includes two rows 300, 302 of contact beams 420, 422 that physically oppose one another, or are oriented in an opposing relationship. The group 210 includes two rows 304, 306 of contact beams 450, 452 that physically oppose one another, or are oriented in an opposing relationship. The contact beams 420, 422, 450, 452 may be associated with signal contacts and ground contacts. For example, the upper group 208 may include contact beams 420, 422 of signal contacts 212 and ground contacts 214 while the lower group 210 contact beams 450, 452 of signal contacts 216 and ground contacts 218. The contact modules 202, 206 hold the signal and ground contacts 212-218 in the upper and lower groups 208, 210. The contact module 204 holds signal contacts 212*a*, 216*a*. The signal contacts 212*a*, 216*a* may be similar to the signal contacts 212, 216. For example, the signal contacts 212*a*, 216*a* may have similar dimensions as the signal contacts 212, 216. The signal contacts 212 and the ground contacts 214 in the upper group 208 may be referred to as upper signal and upper ground contacts while the signal contacts 216 and the ground contacts 218 in the lower group 210 may be referred to as lower signal and lower ground contacts.

The contacts 212, 214 in the upper group 208 are provided within the mating interface 120 (shown in FIG. 1) of the connector assembly 102 (shown in FIG. 1) and the contacts 216, 218 in the lower group 210 are disposed within the mating interface 122 (shown in FIG. 1). As the names imply, the signal contacts 212, 216 may be used to communicate data signals while the ground contacts 214, 218 may be electrically coupled with an electric ground reference to provide a ground plane. For example, the signal contacts 212, 216 may be arranged in differential pairs to communicate signals such as differential signals with mating connectors (not shown) that mate with the connector assembly 102, and the ground contacts 214, 218 may be coupled with the differential pairs of signal contacts 212, 216 to reduce cross-talk, noise, interference, and the like, in the signals communicated using the signal contacts 212, 216.

Figure 3:
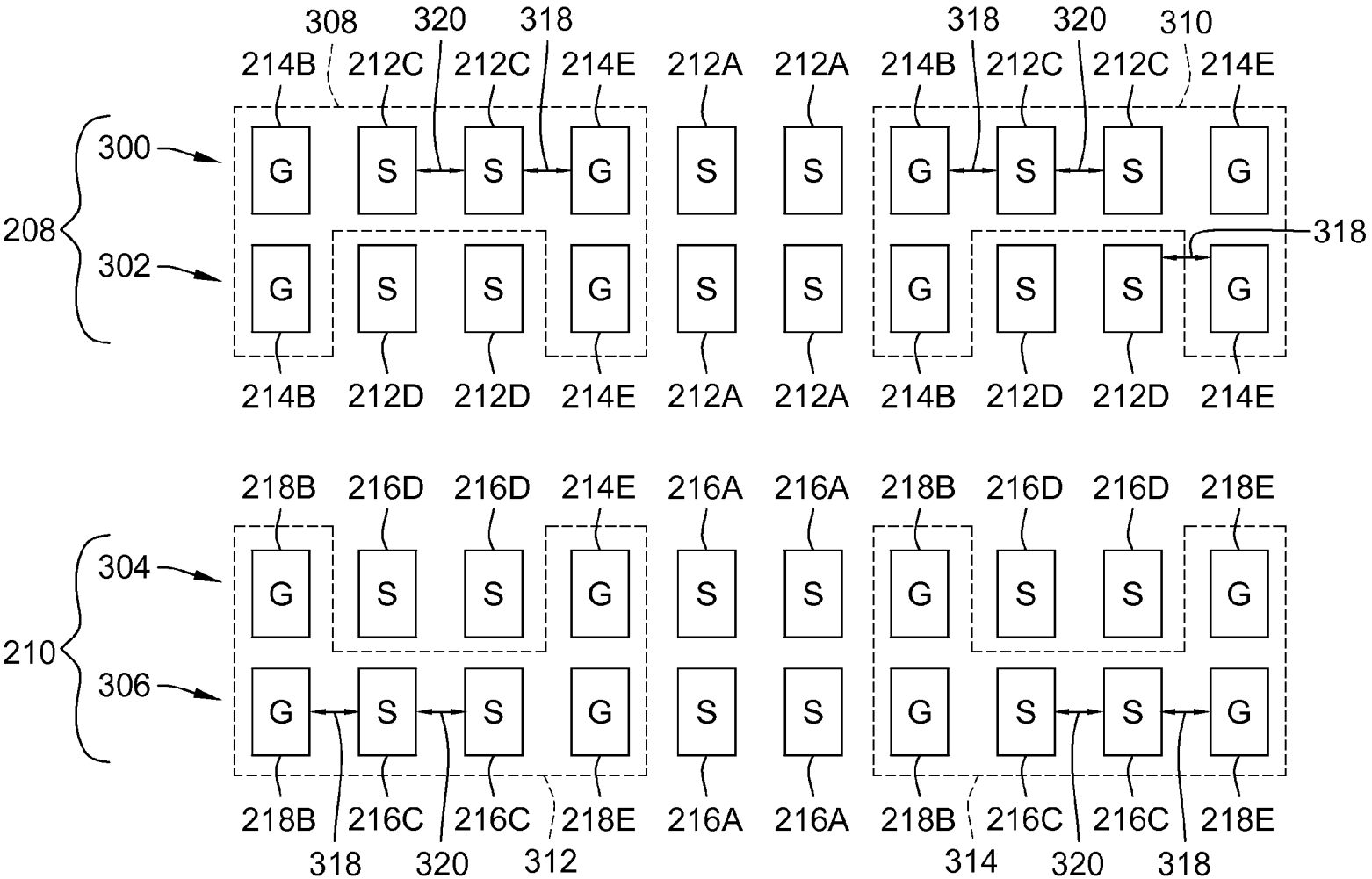
FIG. 3 is a schematic illustration of the arrangement of signal and ground contacts shown in FIG. 2 in the contact module subassembly shown in FIG. 2 in accordance with one embodiment of the present disclosure.

FIG. 3 is a schematic illustration of the arrangement of the signal and ground contacts 212-218 in the contact module subassembly 200 (shown in FIG. 2) in accordance with one embodiment of the present disclosure. FIG. 3 illustrates one arrangement of the signal and ground contacts 212-218, although alternative arrangements may be used. While rectangular shapes are used to represent the contacts 212-218, the cross-sectional shape of the contacts 212-218 may differ from a rectangular shape. The boxes that represent the signal contacts 212, 216 include an "S" while the boxes that represent the ground contacts 214, 218 include a "G." Each individual box represents a single contact beam 420, 422, 450, 452 (shown in FIG. 2) of a signal or ground contact 212-218. The reference number for the contacts 212-218 are shown with an accompanying letter A-E merely to aid in the description of the layout or arrangement of the contacts 212-218 and is not intended to differentiate the contacts 212-218 shown in FIG. 3 from the contacts 212-218 shown in one or more other embodiments.

In the illustrated embodiment, the upper group 208 includes two rows 300, 302 of the contacts 212, 214 and the lower group 210 includes two rows 304, 306 of the contacts 216, 218. The rows 300-306 are linearly aligned subsets or arrangements of the contact beams 420, 422 (shown in FIG. 2) of the contacts 212-218. For example, the S and G boxes shown in FIG. 3 in each row 300-306 are laterally aligned with respect to the contact modules 202-206 (shown in FIG. 2). The boxes that include an "S" and are shown one above the other in the group 208, 210 represent contact beams 420, 422 of two individual signal contacts 212 in the upper group 208. For example, each signal contact 212 in the upper group 208 may be physically and electrically separate from the other signal contacts 212 in the upper group 208 in the contact module 202, 206 (shown in FIG. 2) through which the signal contacts 212 extend. The "S" boxes shown above one another in the group 210 represent the contact beams 450, 452 (shown in FIG. 2) of two individual signal contacts 216 in the lower group 210. For example, each signal contact 216 in the lower group 210 may be physically and electrically separate from the other signal contacts 216 in the lower group 210.

The contacts 212-218 may be arranged in sets 308-314 that communicate differential signals. In the illustrated embodiment, the contacts 212-218 in the sets 308 and 312 are coupled with the first contact module 202 (shown in FIG. 2). The contacts 212-218 in the sets 310 and 314 may be joined with the third contact module 206 (shown in FIG. 2). The signal contacts that are labeled 212A, 216A and that are disposed between the sets 308, 310 and between the sets 312, 314 may be connected with the second contact module 204 (shown in FIG. 2).

As shown in FIG. 3, each of the sets 308, 310 includes two physically and electrically separate signal contacts 212. The signal contacts in the sets 308, 310 are labeled 212C. Additional signal contacts located outside of the sets 308, 310 are labeled 212D. The signal contacts 212C in each set 308, 310 are physically and electrically separate from one another and from the signal contacts 212D. The signal contacts 212D are physically and electrically separate from one another. The signal contacts 212C in each set 308, 310 are paired together to communicate a differential signal. For example, one of the signal contacts 212C in each set 308, 310 may communicate one signal while the other of the signal contacts 212C in each set 308, 310 communicates a complementary signal. As shown in FIG. 3, the signal contacts 212C of each set 308, 310 that communicate a differential signal are disposed horizontally side-by-side. The signal contacts 212D may communicate signals other than differential signals in one embodiment. For example, the signal contacts 212D may communicate single ended signals. Alternatively, the signal contacts 212D may communicate differential signals.

The ground contacts 214B in each set 308, 310 may be electrically and physically common with one another. For example, the contact beams 420, 422 (shown in FIG. 2) of the ground contacts 214B of each set 308, 310 may be merged together within the modules 202, 206 (shown in FIG. 2) such that the vertically oriented pairs of ground contacts 214B are electrically common with one another. Similarly, the ground contacts 214E in each set 308, 310 may be electrically and physically common with one another. In the illustrated embodiment, each pair of the electrically common ground contacts 214B and the electrically common ground contacts 214E are disposed on opposite sides of a differential pair of the signal contacts 212C. For example, each set 308, 310 may include a differential pair of signal contacts 212C oriented horizontally side-by-side with a vertically oriented pair of electrically common ground contacts 214B on one side of the differential pair and a vertically oriented pair of electrically common ground contacts 214E on the other side of the differential pair.

Similar to the sets 308, 310, each of the sets 312, 314 includes two physically and electrically separate signal contacts 216. The signal contacts in the sets 308, 310 are labeled 216C. Additional signal contacts 216 located outside of the sets 308, 310 are labeled 216D. The signal contacts 216C in each set 312, 314 are physically and electrically separate from one another and from the signal contacts 216D. The signal contacts 216D are physically and electrically separate from one another. The signal contacts 216C in each set 312, 314 are paired together to communicate a differential signal. For example, one of the signal contacts 216C in each set 312, 314 may communicate one signal while the other of the signal contacts 216C in each set 312, 314 communicates a complementary signal. As shown in FIG. 3, the signal contacts 216C of each set 312, 314 that communicate a differential signal are disposed horizontally side-by-side. The signal contacts 216D may communicate signals other than differential signals in one embodiment. For example, the signal contacts 216D may communicate single ended signals. Alternatively, the signal contacts 216D may communicate differential signals.

The ground contacts 218B in each set 312, 314 may be electrically and physically common with one another. For example, the contact beams 450, 452 (shown in FIG. 2) of the ground contacts 218B of each set 312, 314 may be merged together within the modules 202, 206 (shown in FIG. 2) such that the vertically oriented pairs of ground contacts 218B are electrically common with one another. Similarly, the ground contacts 218E in each set 312, 314 may be electrically and physically common with one another. In the illustrated embodiment, each pair of the electrically common ground contacts 218B and the electrically common ground contacts 218E are disposed on opposite sides of a differential pair of the signal contacts 216C. For example, each set 312, 314 may include a differential pair of signal contacts 216C oriented horizontally side-by-side with a vertically oriented pair of electrically common ground contacts 218B on one side of the differential pair and a vertically oriented pair of electrically common ground contacts 218E on the other side of the differential pair.

The ground contacts 214B, 214E, 218B, 218E in each set 308-314 are coupled with the differential pairs of signal contacts 212C, 216C. For example, the ground contacts labeled 214B in the set 308 and the ground contacts labeled 214E in the set 308 may be energy coupled, inductively coupled, and/or capacitively coupled with the differential pair of signal contacts labeled 212C in the set 308 to reduce cross-talk, noise, interference, and the like, in the differential signals communicated using the signal contacts 212C. Similarly, the ground contacts labeled 214B in the set 310 and the ground contacts labeled 214E in the set 310 may be energy coupled, inductively coupled, and/or capacitively coupled with the differential pair of signal contacts labeled 212C in the set 310. The ground contacts labeled 218B in the set 312 and the ground contacts labeled 218E in the set 312 may be energy coupled, inductively coupled, and/or capacitively coupled with the differential pair of signal contacts labeled 216C in the set 312. The ground contacts labeled 218B in the set 314 and the ground contacts labeled 218E in the set 314 may be coupled with the differential pair of signal contacts labeled 216C in the set 314.

The ground contacts 214B, 214E, 218B, 218E in each set 308-314 are laterally spaced apart from the signal contacts 212C, 216C arranged in the differential pairs by an intra-set spacing dimension 318. For example, the ground contacts 214B in the second set 310 are separated from the closest signal contact 212C in the differential pair of the second set 310 by the intra-set spacing dimension 318. The intra-set spacing dimension 318 may be approximately the same as the distance between the ground contacts 218B and the signal contacts 216C in the differential pairs of the sets 312, 314. The intra-set spacing dimension 318 may be approximately the same for all sets 308-314 or may differ among the sets 308-314. The signal contacts 212C, 216C in the differential pairs of each set 308-314 are laterally spaced apart from one another by an intra-pair spacing dimension 320. The intra-pair spacing dimension 320 may be approximately the same or differ among the sets 308-314. In one embodiment, the intra-set and intra-pair spacing dimensions 318, 320 are approximately the same among the sets 308-314. The approximately equidistant spacing between the signal and ground contacts 212-218 in the sets 308-314 and across the rows 300 and 306 may increase the coupling of the ground contacts 214, 218 to the differential signal pairs of signal contacts 212C, 216C. For example, the equidistant spacing between the ground and signal contacts 212-218 throughout the rows 300-306 may reduce the noise, cross-talk, interference, and the like, of the differential signals communicated by the signal contacts 212, 216.

Figure 4:
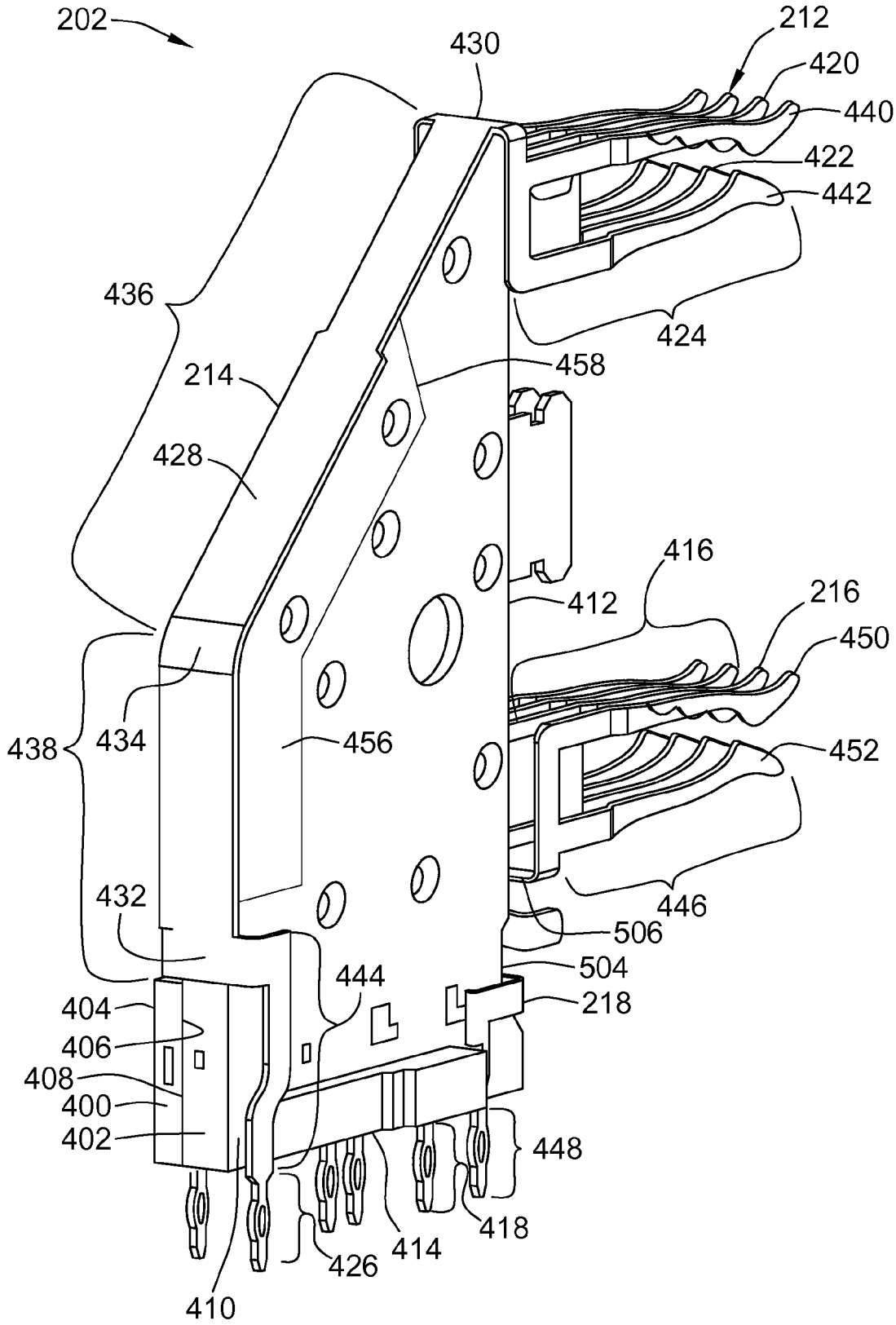
FIG. 4 is a perspective view of a contact module shown in FIG. 2 in accordance with one embodiment of the present disclosure.
Figure 5:
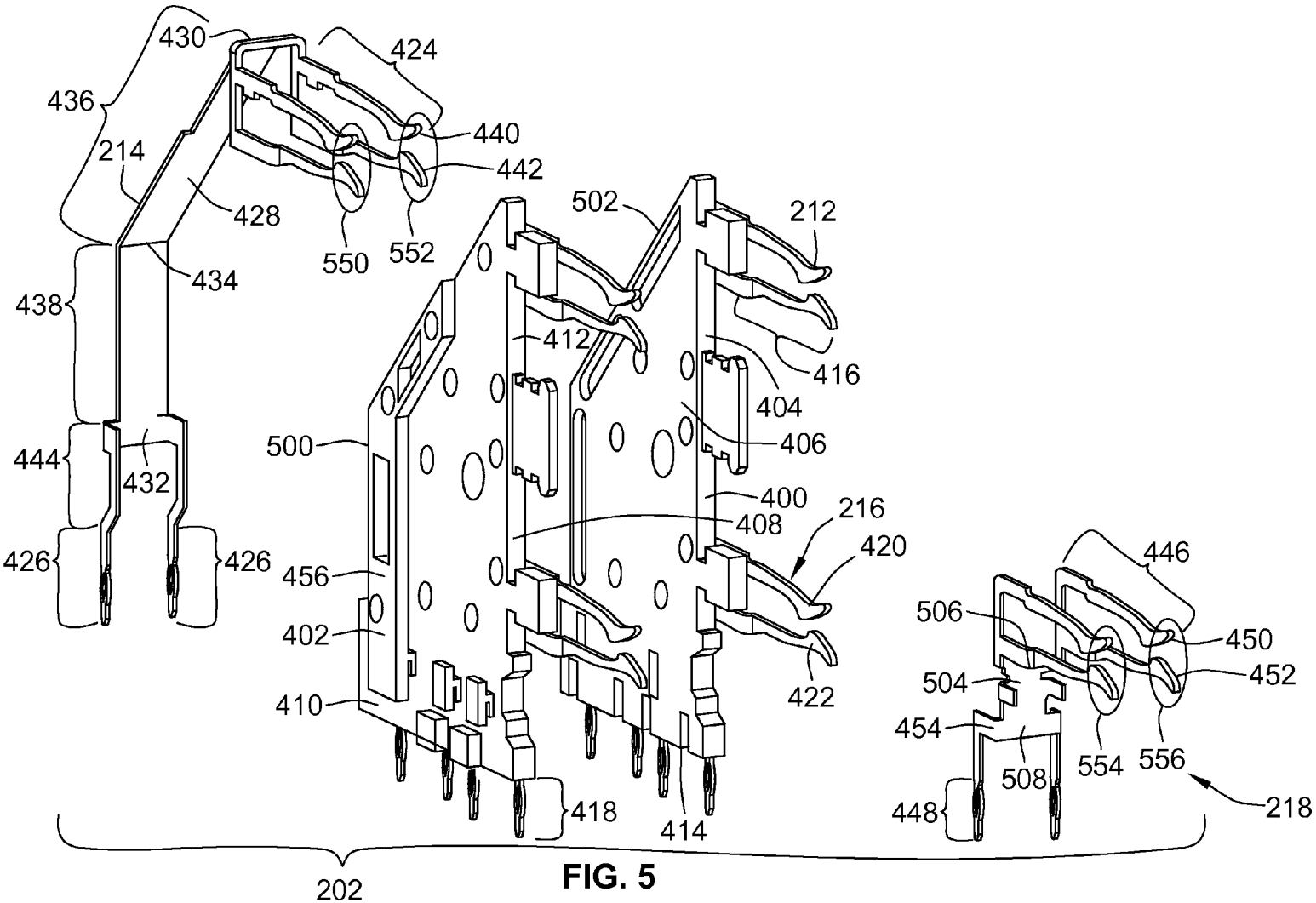
FIG. 5 is an exploded view of the contact module shown in FIG. 2 in accordance with one embodiment of the present disclosure.

FIG. 4 is a perspective view of the contact module 202 in accordance with one embodiment of the present disclosure. FIG. 5 is an exploded view of the contact module 202. While FIGS. 4 and 5 illustrate and describe the contact module 202, the illustrations and description may equally apply to the contact module 206 (shown in FIG. 2). The contact module 202 is an approximately planar body that includes two chicklets 400, 402 in an abutted relationship with one another. For example, the chicklets 400, 402 may be disposed adjacent to one another in the contact module 202. The chicklets 400, 402 may be approximately planar bodies that extend between opposite sides 404, 406, 408, 410. For example, the thickness of each chicklet 400, 402 between the sides 404 and 406, or between the sides 408 and 410, may be less than the dimensions of each chicklet 400, 402 in at least two other directions that are oriented perpendicular to the thickness. The use of the term planar to describe the module 202 and the chicklets 400, 402 is not intended to require that the sides 404-410 are entirely planar. The sides 404-410 may include protrusions and recesses.

The chicklets 400, 402 include several edges 412, 414, 500 (shown in FIG. 5), 502 (shown in FIG. 5) that extend around the periphery of the sides 404-410. For example, the edges 412, 414, 500, 502 of the chicklet 400 border or enclose the outer perimeter of the sides 404, 406. The chicklets 400, 402 may have approximately rectangular shaped bodies. For example, the chicklets 400, 402 may have rectangular shaped bodies with a corner cut out or removed from the rectangle. Alternatively, the chicklets 400, 402 may have rectangular-shaped bodies with no corners removed or the shape of another polygon. The edges 412, 414, 500, 502 include a mating edge 412 that intersects or adjoins both a mounting edge 414 and a back edge 502 that is disposed opposite of the mounting edge 414. Another back edge 500 is disposed opposite of the mating edge 412 and intersects or adjoins the back edge 502 and the mounting edge 414. As shown in FIGS. 4 and 5, the mating and back edges 412, 500 are oriented approximately parallel to one another while the mounting and back edges 414, 502 are angled with respect to one another. The back edges 500, 502 intersect one another at an obtuse angle in the illustrated embodiment.

The sides 404, 410 of the contact module 202 include outwardly extending ridges 456. The ridges 456 protrude from the sides 404, 410 of the contact modules 202. In the illustrated embodiment, the ridges 456 extend along the back edges 500, 502. For example, the ridge 456 shown in FIG. 5 may extend along the back edge 500 from the mounting edge 414 to the intersection of the back edges 500, 502, and from the intersection of the back edges 500, 502 toward the mating edge 412. The ridge 456 may terminate at an end 458 located between the back edge 502 and the mating edge 412.

The chicklets 400, 402 hold the signal contacts 212, 216. For example, the chicklets 400, 402 may be dielectric bodies that are overmolded onto the signal contacts 212, 216. The signal contacts 212, 216 extend between mating ends 416 and mounting ends 418. An overmolded portion of the signal contacts 212, 216 extends between the mating and mounting ends 416, 418 within the chicklets 400, 402. The mating ends 416 include the physically opposing contact beams 420, 422 that protrude from the mating edge 412 of each chicklet 400, 402. The contact beams 420, 422 of each signal contact 212, 216 are electrically separate from one another in the illustrated embodiment. The mating ends 416 engage corresponding contacts (not shown) in a mating connector (not shown) to communicate signals therebetween. The mounting ends 418 of each signal contact 212, 216 are independently joined with the circuit board 104 (shown in FIG. 1) to electrically couple the signal contacts 212, 216 with the circuit board 104.

The ground contact 214 has an approximate "L" shape and extends between a mating end 424 and a mounting end 426. The ground contacts 214 include or are formed from a conductive material. For example, each ground contact 214 may be stamped and formed from a common sheet of a metal or metal alloy. The mating end 424 includes two sets of opposed elongated contact beams 440, 442 that protrude past the mating edge 412 of the contact module 202 and of the chicklets 400, 402. In the illustrated embodiment, the contact beams 440, 442 are approximately the same size and/or dimensions of the contact beams 420, 422 of the signal contacts 212, 216. The mating ends 424 engage corresponding contacts in a mating connector (not shown) to electrically couple the contacts with an electric ground reference of the circuit board 104 (shown in FIG. 1).

The mounting ends 426 include the portions of the ground contact 214 that protrude past the mounting edge 414 of the chicklets 400, 402 and the contact module 202. In the illustrated embodiment, the mounting ends 426 are opposed eye-of-needle pins that are inserted into the circuit board 104. Alternatively, the mounting ends 426 may include differently shaped and/or dimensioned bodies that couple with the circuit board 104.

The mating and mounting ends 424, 426 are joined with a contact body 428 by straddle sections 430, 432 of the ground contact 214. The straddle sections 430, 432 are elongated bars in the illustrated embodiment. The straddle sections 430, 432 interconnect vertical sets 550, 552 of the contact beams 440, 442 and the mounting ends 426 with the contact body 428. The straddle sections 430, 432 are oriented perpendicular to the direction of elongation of the contact beams 440, 442. The straddle sections 430, 432 extend across the contact module 202 in directions that are parallel to the thickness of the contact module 202. For example, the straddle sections 430, 432 may be oriented in directions that are perpendicular to the planes defined by the sides 404-410. The section 430 straddles the contact module 202 such that the vertical sets 550, 552 of the contact beams 440, 442 are disposed along opposite sides 404, 410 of the contact module 202. The contact beams 440, 442 extend approximately parallel to the planes defined by the sides 404, 410 of the contact module 202. As described above, the straddle section 430 may have a length dimension that positions the contact beams 440, 442 approximately equidistant from the contact beams 420 of the differential pair of signal contacts 212 disposed between the contact beams 440, 442.

The section 432 straddles the contact module 202 such that the mounting ends 426 are disposed along opposite sides 404, 410 of the contact module 202. The mounting ends 426 are joined to the straddle section 432 by bridge portions 444. The bridge portions 444 are elongated sections of the ground contact 214 that extend along the opposite sides 404, 410 of the contact module 202 between the straddle section 432 and the mounting ends 426.

The contact body 428 is an elongated, approximately planar body. The contact body 428 includes a bend 434 disposed between sections 436, 438 of the body 428. As shown in FIG. 5, the bend 434 may orient the two sections 436, 438 at an obtuse angle with respect to one another. Alternatively, the bend 434 may orient the sections 436, 438 at a different angle. The ground contact 214 is disposed along the back edges 500, 502 (shown in FIG. 5) of the chicklets 400, 402. The section 436 may abut the back edge 502 and the section 438 may abut the back edge 500. The contact body 428 runs alongside the back edges 500, 502 remote from the corresponding opposite mating and mounting edges 412, 414 in the illustrated embodiment. The contact body 428 partially bounds the outer perimeter of the contact module 202 along the back edges 500, 502. The width of the sections 436, 438 in a direction that is perpendicular to the length of the sections 436, 438 and the thickness of the sections 436, 438 is approximately the same as the combined thickness of the chicklets 400, 402 along the edges 500, 502. The sections 436, 438 may have a width that is approximately the same as the thickness of the contact module 202 in a direction that is perpendicular to the planes defined by the sides 404-410 (shown in FIG. 4).

The placement of the ground contact 214 along the outside of the contact module 202, such as in an abutted relationship with adjoining or intersecting back edges 500, 502 (shown in FIG. 5) of the contact module 202 and the chicklets 400, 402 enables the ground contact 214 to be provided with the contact module 202 while not significantly adding to the thickness of the contact module 202. For example, the ground contact 214 shown in FIG. 5 is positioned along the back of the contact module 202 and only extends past the outer sides 404, 410 of the contact module 202 at the mating and mounting ends 424, 426. The ground contact 214 is positioned along the back of the contact module 202 with the straddle sections 430, 432 positioning the mating and mounting ends 424, 426 in a desired relationship with the mating and mounting ends 416, 418 of the signal contacts 212. For example, the ground contact 214 is positioned outside of the contact module 202 without adding to the thickness of the contact module 202 while placing the mating ends 424 on opposite sides of the signal contacts 212. As a result, the thickness of the contact modules 202, 206 and subassembly 200 may be reduced in order to provide an increased density of signal and ground contacts 212-218.

The ground contact 218 has an approximate "L" shape and extends between a mating end 446 and a mounting end 448. The mating end 446 includes two sets 554, 556 of the vertically opposed contact beams 450, 452 that protrude past the mating edge 412 of the contact module 202. In the illustrated embodiment, the contact beams 450, 452 are approximately the same size and/or dimensions of the contact beams 420, 422 of the signal contacts 212, 216. The mating ends 446 engage corresponding contacts in a mating connector (not shown) to electrically couple the contacts with an electric ground reference of the circuit board 104 (shown in FIG. 1). The mounting ends 448 include the portions of the ground contact 218 that protrude past the mounting edge 414 of the contact module 202. In the illustrated embodiment, the mounting ends 448 are opposed eye-of-needle pins that are inserted into the circuit board 104, but alternatively may be a different size and/or shape.

The mating and mounting ends 446, 448 are joined with a contact body 504 (shown in FIG. 5) by straddle sections 506, 508 (shown in FIG. 5). The straddle sections 506, 508 are elongated bars in the illustrated embodiment. The straddle sections 506, 508 interconnect the contact beams 450, 452 and the mounting ends 448 with the contact body 504. The straddle sections 506, 508 are oriented perpendicular to the direction of elongation of the contact beams 450, 452. The straddle sections 506, 508 extend across the contact module 202 in directions that are parallel to the thickness of the contact module 202. The section 506 straddles the contact module 202 such that the contact beams 450, 452 are disposed along opposite sides 404, 410 of the contact module 202. The contact beams 450, 452 extend approximately parallel to the planes defined by the sides 404, 410. The straddle section 506 may have a length dimension that positions the contact beams 450, 452 approximately equidistant from the contact beams 420 of the differential pair of signal contacts 216 disposed between the contact beams 440, 442.

The section 508 straddles the contact module 202 such that the mounting ends 448 are disposed along opposite sides 404, 410 of the contact module 202. The mounting ends 448 are joined to the straddle section 508 by bridge portions 454. The bridge portions 454 are elongated sections of the ground contact 218 that extend along the opposite sides 404, 410 of the contact module 202 between the straddle section 508 and the mounting ends 448.

As shown in FIG. 5, the ground contact 218 is disposed along the mating edges 412 of the chicklets 400, 402 and the module 202. For example, the ground contact 218 abuts the mating edges 412. The placement of the ground contact 218 along the outside of the contact module 202, such as in an abutted relationship with the mating edges 412 enables the ground contact 218 to be provided while not significantly adding to the thickness of the contact module 202. For example, the ground contact 218 may be positioned along the front of the contact module 202 with the straddle sections 506, 508 positioning the mating and mounting ends 446, 448 in a desired relationship with the mating and mounting ends 416, 418 of the signal contacts 216. For example, the ground contact 218 is positioned outside of the contact module 202 without adding to the thickness of the contact module 202 while placing the mating ends 446 on opposite sides of the signal contacts 216.

Figure 6:
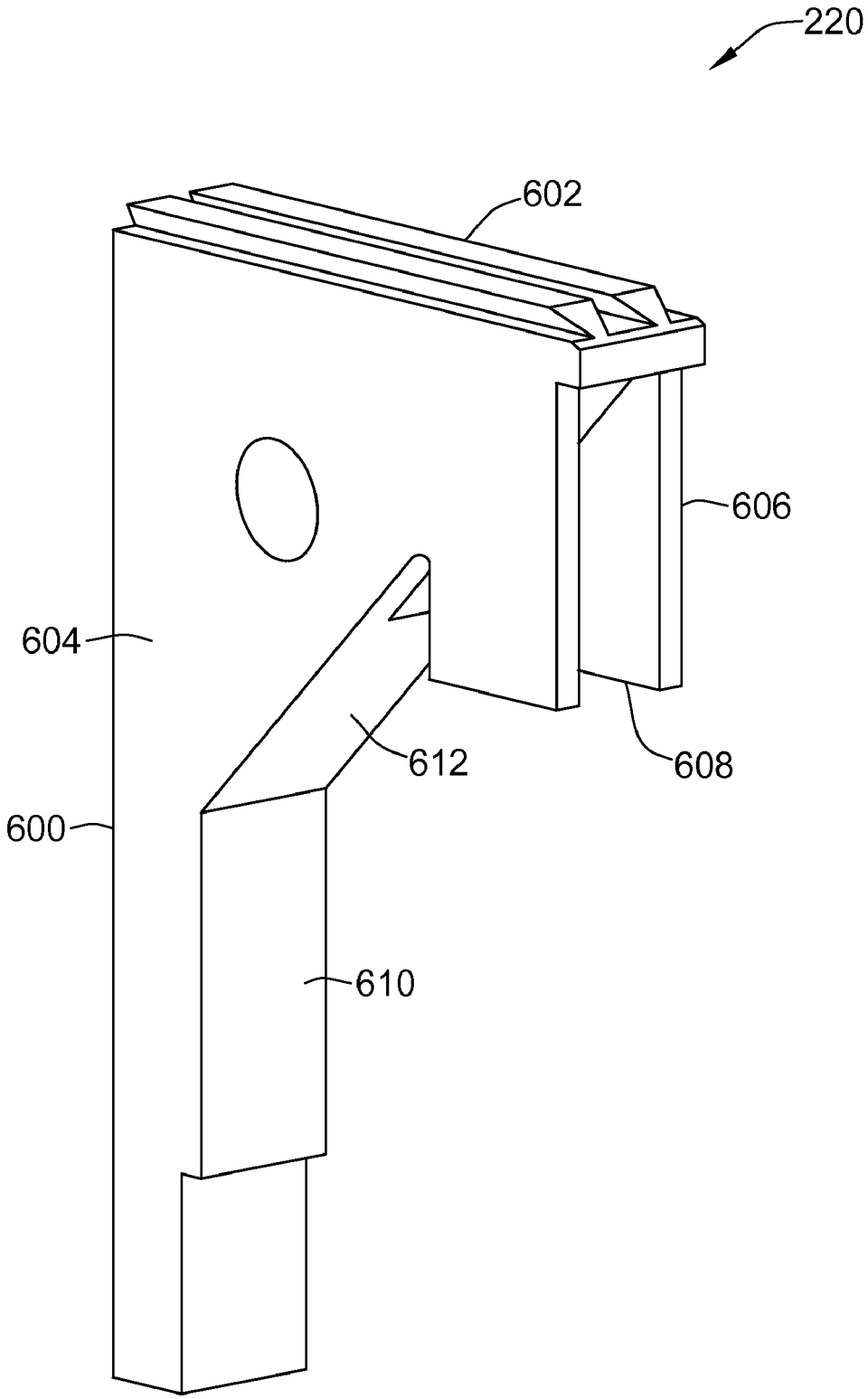
FIG. 6 is a perspective view of a cap body shown in FIG. 2 in accordance with one embodiment of the present disclosure.

FIG. 6 is a perspective view of the cap body 220 in accordance with one embodiment of the present disclosure. As shown in FIG. 2, the cap body 220 is positioned above and behind the contact modules 202, 206. The cap body 220 shown in FIG. 6 includes a rear surface 600 and a bearing surface 602 oriented approximately perpendicular to one another. The cap body 220 may include, or be formed from, a dielectric material. Alternatively, the cap bodies 220 may include, or be formed from, a conductive material, such as a metal or metal alloy. The rear surface 600 may be approximately coextensive with the loading side 118 (shown in FIG. 1) of the housing 110 (shown in FIG. 1) when the contact module subassembly 200 (shown in FIG. 2) with the cap body 220 is loaded into the housing 110. The rear surface 600 may enclose the contact modules 202, 206 within the housing 110.

The bearing surface 602 is received into the housing 110 (shown in FIG. 1) and may be oriented approximately parallel to the top side 114 (shown in FIG. 1) of the housing 110 when the cap body 220 is placed within the housing 110. The top side 114 of the housing 110 and the bearing surface 602 may receive a loading force that is applied to the top of the connector cage 106 (shown in FIG. 1) when the connector cage 106 and the connector assembly 102 (shown in FIG. 1) are mounted to the circuit board 104 (shown in FIG. 1). For example, a user or operator of the system 100 (shown in FIG. 1) may mount the connector cage 106 and the connector assembly 102 by applying a downward force onto the connector cage 106. This force may be transferred to the top side 114 of the housing 110 to seat the connector assembly 102 onto the circuit board 104. The cap bodies 220 may receive this force and direct the force away from the contact modules 202, 206 in order to protect the contact modules 202, 206.

The cap body 220 extends between opposite sides 604, 606 that are approximately parallel to one another in the illustrated embodiment. Each of the sides 604, 606 includes a downwardly protruding securing finger 608. The cap body 220 includes an interior vertical wall 610 disposed opposite of the rear surface 600 and an interior angled wall 612 that extends from the vertical wall 610 to the bearing surface 602. The angled wall 612 may intersect both the vertical wall 610 and the bearing surface 602. In one embodiment, the angle between the angled wall 612 and the vertical wall 610 may be approximately the same as the angle between the sections 436, 438 (shown in FIG. 4) of the ground contact 214 (shown in FIG. 2) and/or the angle between the back edges 500, 502 (shown in FIG. 5) of the contact modules 202, 206 (shown in FIG. 2).

During assembly of the contact module subassembly 200 (shown in FIG. 2), the ground contacts 214 (shown in FIG. 2) are coupled to the back edges 500, 502 (shown in FIG. 5) of the contact modules 202, 206 (shown in FIG. 2). The cap bodies 220 are lowered onto the contact modules 202, 206. For example, the cap bodies 220 may be placed onto the back edges 502 of the contact modules 202, 206 such that the ground contacts 214 are located between the contact modules 202, 206 and the interior walls 610, 612 of the cap bodies 220. The fingers 608 may engage the ridges 456 (shown in FIG. 4) of the contact modules 202, 206 to secure the ground contacts 214 to the contact modules 202, 206. For example, the fingers 608 may slide along and engage the ends 458 (shown in FIG. 4) of the ridges 456. The engagement between the fingers 608 and the ends 458 may prevent the cap bodies 220 from rearwardly sliding away from the mating edges 412 (shown in FIG. 4) along the angled back edges 502 of the contact modules 202, 206.

Figure 7:
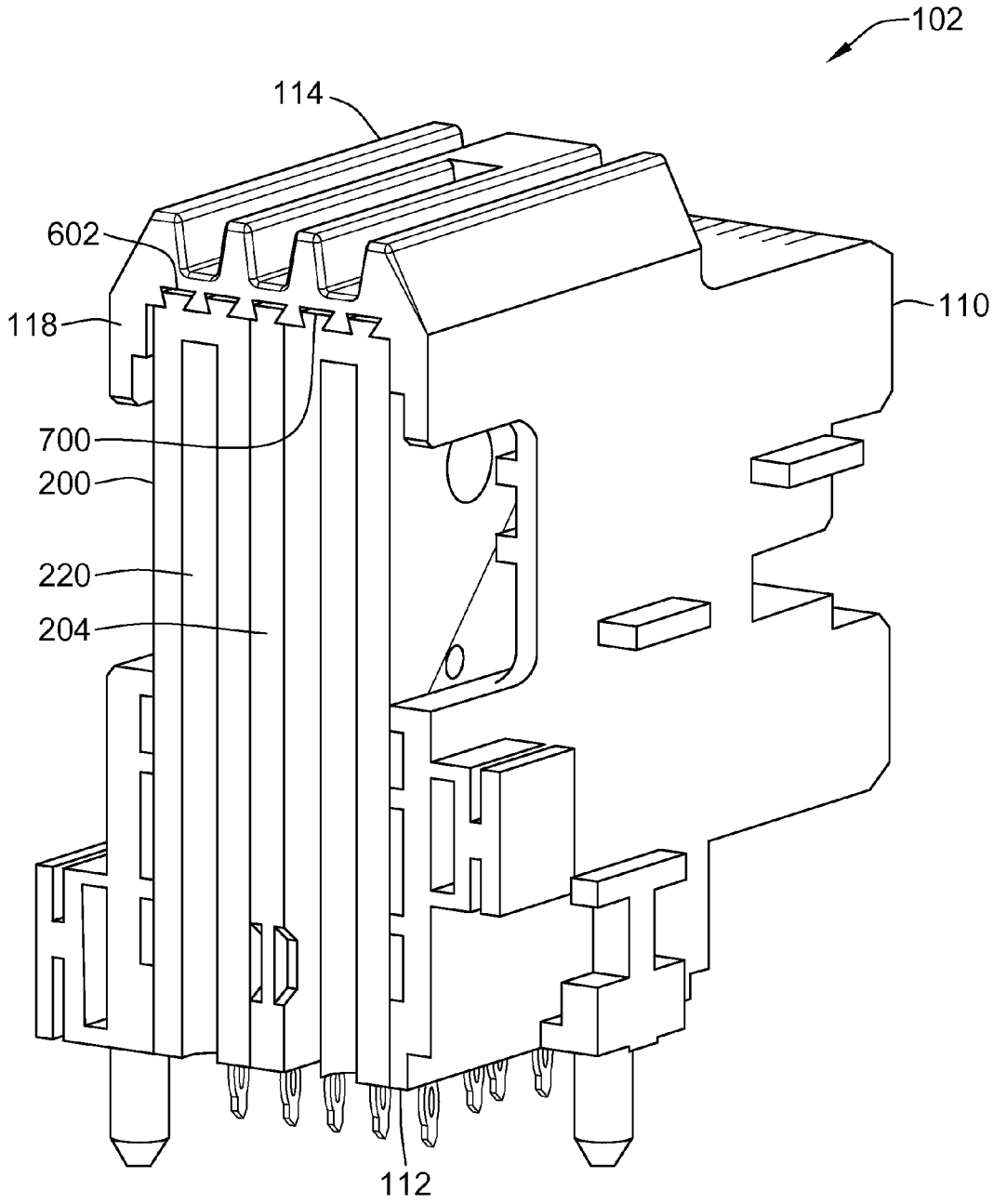
FIG. 7 is a rear perspective view of the connector assembly shown in FIG. 1 in accordance with one embodiment of the present disclosure.

FIG. 7 is a rear perspective view of the connector assembly 102 in accordance with one embodiment of the present disclosure. The contact module subassembly 200 is loaded into the loading side 118 of the housing 110 of the connector assembly 102. As shown in FIG. 7, the bearing surfaces 602 of the cap bodies 220 and the contact module 204 engage an interior surface 700 of the housing 110 that is located underneath and approximately parallel to the top side 114 of the housing 110. The engagement between the bearing surfaces 602 and the interior surface 700 may force the cap bodies 220 in a downward direction toward the mounting side 112 of the housing 110. As the bearing surfaces 602 are forced downward, the cap bodies 220 move downward. The angled walls 612 (shown in FIG. 6) of the cap bodies 220 cause the cap bodies 220 to downwardly slide along the back edges 502 (shown in FIG. 5) of the contact modules 202, 206. The cap bodies 220 may continue to downwardly slide until the fingers 608 (shown in FIG. 6) of the cap bodies 220 engage the ends 458 (shown in FIG. 4) of the ridges 456 (shown in FIG. 4) of the contact modules 202, 206.

The engagement between the fingers 608 (shown in FIG. 6) and the ends 458 (shown in FIG. 4) prevent continued rearward sliding of the cap bodies 220 along the back edges 502 (shown in FIG. 5) of the contact modules 202, 206 (shown in FIG. 2). The fingers 608 engage the ends 458 to translate additional downward force on the cap bodies 220 into a downward force that is applied to the ground contacts 214 (shown in FIG. 2). For example, the downward force applied to the cap bodies 220 may push the cap bodies 220 onto the ground contacts 214 to secure the ground contacts 214 against the back edges 500, 502 (shown in FIG. 5) of the contact modules 202, 206.

Figure 8:
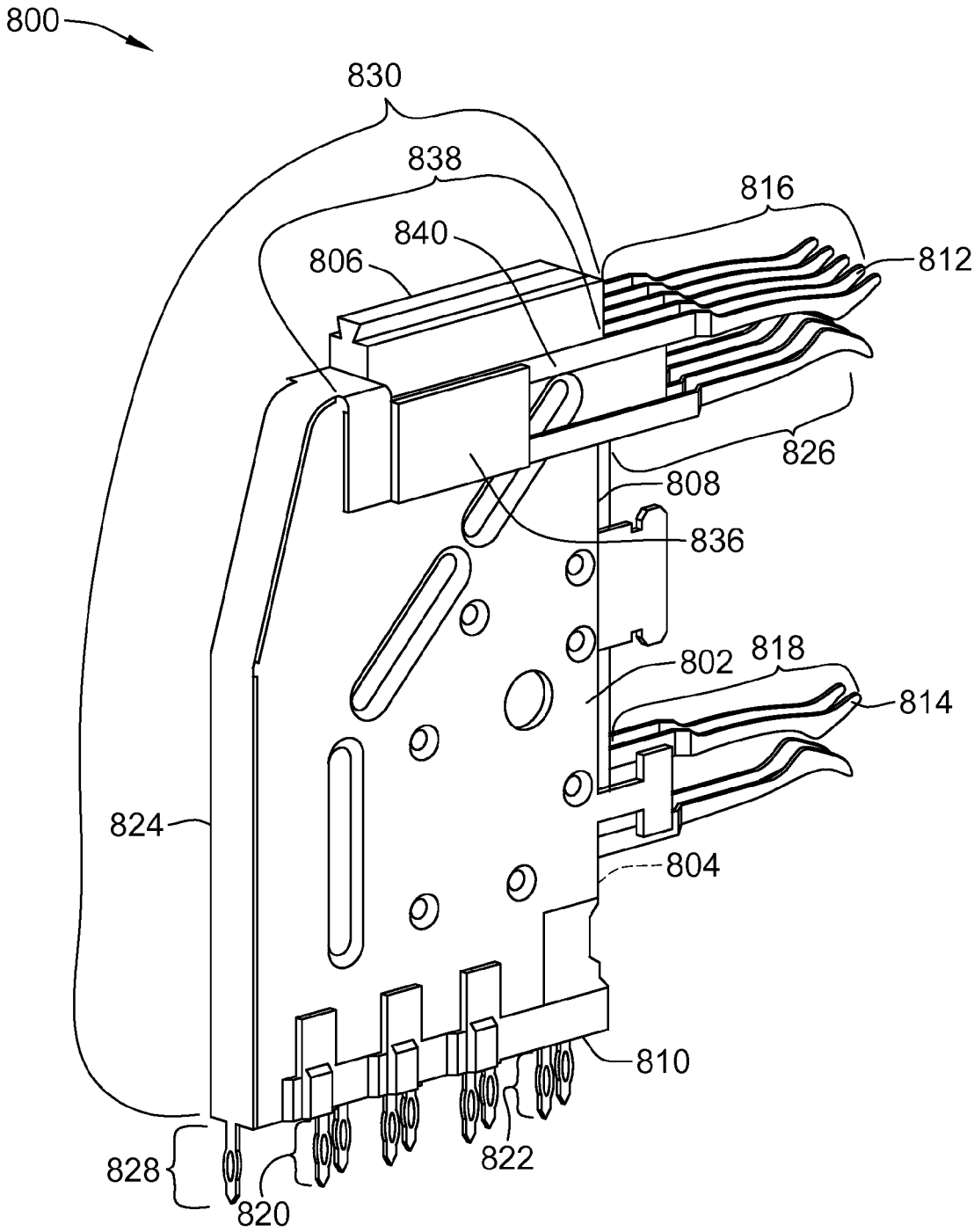
FIG. 8 is a perspective view of a contact module in accordance with another embodiment of the present disclosure.
Figure 9:
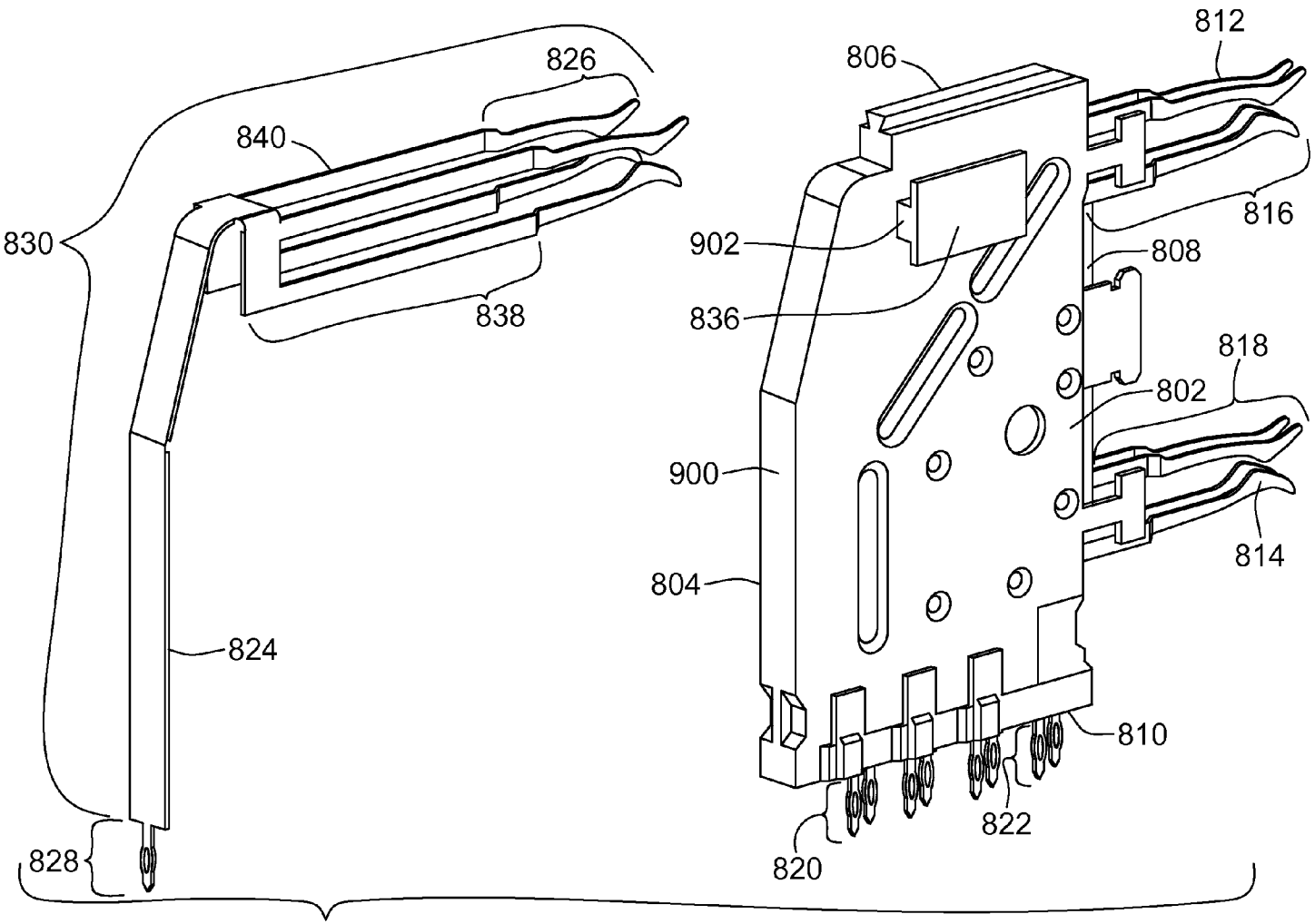
FIG. 9 is an exploded view of the contact module shown in FIG. 8 in accordance with another embodiment of the present disclosure.

FIG. 8 is a perspective view of a contact module 800 in accordance with another embodiment of the present disclosure. FIG. 9 is an exploded view of the contact module 800. The contact module 800 may be similar to the contact modules 202, 206 (shown in FIG. 2). For example, the contact module 800 may include a dielectric body that has signal contacts 812, 814 extending therethrough. The contact module 800 may be part of a contact module subassembly similar to the contact module subassembly 200 (shown in FIG. 2) that is loaded into the housing 110 (shown in FIG. 1) of the connector assembly 102 (shown in FIG. 1). The signal contacts 812, 814 may mate with mating connectors (not shown) to communicate differential signals.

The contact module 800 extends between opposite sides 802, 804. Several edges interconnect the sides 802, 804 and include a back edge 806, a mating edge 808, a mounting edge 810, and a back edge 900 (shown in FIG. 9). The back edge 806 opposes the mounting edge 810 and the back edge 900 opposes the mating edge 808. Mating ends 816, 818 of the signal contacts 812, 814 include the portions of the signal contacts 812, 814 that protrude from the mating edge 808. The signal contacts 812, 814 extend through the contact module 800 and protrude from the mounting edge 810. The portions of the signal contacts 812, 814 that protrude from the mounting edge 810 are mounting ends 820, 822 of the signal contacts 812, 814. The mating ends 816, 818 engage contacts (not shown) in a mating connector (not shown) to electrically couple the contact module 800 with the mating connector. The mounting ends 820, 822 may be mounted to the circuit board 104 (shown in FIG. 1) to electrically couple the contact module 800 with the circuit board 104. The signal contacts 812, 814 may communicate signals between the mating connector and the circuit board 104. In the illustrated embodiment, the signal contacts 812, 814 may be arranged in differential pairs to communicate differential signals.

The contact module 800 includes a ground contact 824 that extends outside of the contact module 800 along an outer periphery of the contact module 800. Although not shown in FIG. 8 or 9, the contact module 800 may include a lower ground contact that is similar to the ground contact 218 (shown in FIG. 2). The ground contact 218 may be joined to the edge 808 of the module 800. In the illustrated embodiment, the ground contact 824 includes a mating end 826, a mounting end 828 and a body 830 that extends between the mating and mounting ends 826, 828. The mating end 826 includes the section of the ground contact 824 that protrudes from the mating edge 808. The mounting end 828 includes the section of the ground contact 824 that protrudes from the mounting edge 810. The mating end 826 of the ground contact 824 may mate with a mating connector (not shown) and the mounting end 828 may be mounted to the circuit board 104 (shown in FIG. 1) to provide a conductive pathway between the mating connector and an electric ground reference of the circuit board 104.

The ground contact 824 extends along the back edges 806, 900 of the contact module 800. As shown in FIGS. 8 and 9, the body 830 has a shape that matches or least approximately matches the contour or shape of the back edges 806, 900. The ground contact 824 includes mating ends 826. The body 830 includes a forked portion 838 that is joined with the mating ends 826. The forked portion 838 extends downward from the body 830 and includes four elongated extensions 840, with each extension 840 joined to a different mating end 826. As shown in the illustrated embodiment, the extensions 840 and mating ends 826 are arranged in a two-by-two array, with two extensions 840 and mating ends 826 linearly aligned along each of two perpendicular directions.

As shown in FIG. 8, the mating ends 826 of the ground contact 824 are disposed on opposite sides of pairs of the mating ends 816 of the signal contacts 812. The distance between adjacent mating ends 816 of the signal contacts 812 and the distance between the mating end 816 of a signal contact 812 and an adjacent mating end 826 of the ground contact 824 may be approximately the same. For example, the mating ends 816, 826 may be equally spaced apart from one another.

The contact module 800 includes retention plates 836 that secure the ground contact 824 to the contact module 800. The retention plates 836 may be oriented approximately parallel to the sides 802, 804. The ground contact 824 engages the retention plates 836 to secure the ground contact 824 to the sides 802, 804 of the contact module 800. The retention plates 836 are shown in FIGS. 8 and 9 as planar bodies that are coupled to and are spaced away from each of the opposite sides 802, 804. Each of the retention plates 836 is connected to and spaced apart from the sides 802, 804 by a beam 902 (shown in FIG. 9) that is coupled with the sides 802, 804. The ground contact 824 is joined with the contact module 800 by loading the mating ends 826 and the extensions 840 through the space between the retention plates 836 and the sides 802, 804 on opposite sides of the beam 902. The ground contact 824 is placed into an abutted relationship between the body 830 and the back edges 806, 900 (shown in FIG. 9). The engagement between the extensions 840 and the retention plates 836 secures the ground contact 824 to the contact module 800. Once coupled to the contact module 800, the ground contact 824 may mate with a mating connector that communicates a differential signal with the signal contacts 812 while reducing noise and/or cross-talk in the signals communicated using the signal contacts 812 located between the mating ends 826 of the ground contact 824.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and merely are example embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector assembly comprising:

a contact module including a dielectric body with mating and mounting edges and corresponding opposite back edges;

signal contacts held within the contact module, the signal contacts including mating and mounting ends that protrude from the mating and mounting edges of the contact module, respectively, the signal contacts arranged in a differential pair to convey differential signals; and a ground contact coupled to the contact module, the ground contact including mating and mounting ends that protrude from the mating and mounting edges of the contact module, respectively, wherein the ground contact runs alongside the back edges from the mounting edge to the mating edge.

2. The connector assembly of claim 1, wherein the contact module extends between opposite sides and the ground contact includes a body that extends between the mating and mounting ends of the ground contact, the body having a width that is at least as narrow as a thickness of the contact module in a direction that is perpendicular to the sides of the contact module.

3. The connector assembly of claim 1, wherein the ground contact includes a planar body that extends between the mating and mounting ends of the ground contact and abuts the back edges of the contact module.

4. The connector assembly of claim 1, wherein the contact module extends between opposite sides and the ground contact includes a body that extends between the mating and mounting ends of the ground contact, the ground contact including straddle sections that interconnect the mating and mounting ends to the body and are oriented perpendicular to the sides of the contact module.

5. The connector assembly of claim 1, wherein the mating ends of the signal contacts comprise contact beams, the contact beams of different signal contacts physically opposing one another.

6. The connector assembly of claim 1, wherein the mating ends of the ground contact are disposed on opposite sides of the mating ends of the signal contact.

7. The connector assembly of claim 1, wherein the contact module extends between opposite sides bounded by the mating and mounting edges and the back edges, further wherein the mating ends of the ground contact are oriented parallel to the sides of the contact module.

8. The connector assembly of claim 1, wherein the signal contacts are upper signal contacts, further comprising lower signal contacts having mating ends that protrude from the mating edge of the contact module and mounting ends that protrude from the mounting edge of the contact module.

9. The connector assembly of claim 8, wherein the ground contact is an upper ground contact associated with the upper signal contacts, further comprising a lower ground contact associated with the lower signal contacts, the lower ground contact having mating ends that protrude from the mating edge of the contact module and mounting ends that protrude from the mounting edge of the contact module.

10. The connector assembly of claim 9, wherein the lower ground contact is joined to the mating edge of the contact module.

11. A connector assembly comprising:

a housing including a mating side having mating faces adapted to mate with mating connectors;

contact modules held in the housing, the contact modules including planar bodies with mating and mounting edges and corresponding opposite back edges;

signal contacts held by the contact modules, the signal contacts including contact beams that protrude from the mating edges of the contact modules and oppose one another, an upper set of the contact beams disposed in one of the mating faces of the housing, a lower set of the contact beams disposed in another one of the mating faces, the signal contacts arranged in differential pairs in each of the upper and lower sets to separately convey differential signals; and ground contacts coupled to the contact modules, the ground contacts including contact beams that protrude from the mating edges of the contact modules, the contact beams of the ground contacts arranged on opposite sides of the differential pairs of the signal contacts in each of the upper and lower sets of signal contacts, wherein the ground contacts have contact beams arranged on opposite sides of the signal contacts in the upper set that are joined to a common body running alongside the back edges of the contact modules from the mounting edges to the mating edges.

12. The connector assembly of claim 11, wherein the back edges of the contact modules intersect one another.

13. The connector assembly of claim 11, wherein the contact beams of the signal contacts in the upper set oppose one another along a horizontal direction and the contact beams of the ground contact that are disposed on opposite sides of the signal contacts in the upper set are electrically common and oppose one another along a vertical direction.

14. The connector assembly of claim 11, wherein the contact modules extend between opposite sides and the ground contacts include bodies having widths that are at least as narrow as thicknesses of the contact modules in a direction that is perpendicular to the sides of the contact modules.

15. The connector assembly of claim 11, wherein the ground contacts include planar bodies that abut the back edges of the contact modules.

16. The connector assembly of claim 11, wherein the contact modules extend between opposite sides, the ground contacts abutting the back edges of the contact modules and straddling the back edges that intersect the mating edges of the contact modules in directions that are transverse to the sides.

17. The connector assembly of claim 11, wherein the contact modules extend between opposite sides bounded by the mating and mounting edges and the back edges, further wherein the contact beams of the ground contacts are oriented parallel to the sides of the contact modules.

18. The connector assembly of claim 11, wherein the contact modules extend between opposite sides, the contact beams of the signal contacts and the ground contacts linearly aligned with one another in directions that are perpendicular to the sides in the mating faces.

19. The connector assembly of claim 11, further comprising a cap body coupled to at least one of the contact modules, the cap body at least partially enclosing at least one of the ground contacts between the back edges of the at least one of the contact modules and the cap body.

20. The connector assembly of claim 11, further comprising a cap body coupled to at least one of the contact modules to at least partially enclose at least one of the ground contacts between the at least one of the contact modules and the cap body, wherein the cap body transfers a downward force applied to the cap body to seat the signal contacts and the ground contacts in a circuit board.

* * * * *